US007314292B2

(12) United States Patent
Marra et al.

(10) Patent No.: US 7,314,292 B2
(45) Date of Patent: Jan. 1, 2008

(54) LIGHTING DEVICE

(75) Inventors: Johannes Marra, Eindhoven (NL); Bas Van Der Heijden, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/526,924

(22) PCT Filed: Sep. 1, 2003

(86) PCT No.: PCT/IB03/03854

§ 371 (c)(1),
(2), (4) Date: Mar. 8, 2005

(87) PCT Pub. No.: WO2004/025172

PCT Pub. Date: Mar. 25, 2004

(65) Prior Publication Data

US 2006/0087849 A1 Apr. 27, 2006

(30) Foreign Application Priority Data

Sep. 12, 2002 (EP) ..... 02078761

(51) Int. Cl.
*F21V 7/00* (2006.01)

(52) U.S. Cl. ..... 362/307; 362/311; 362/343; 362/355

(58) Field of Classification Search ..... 362/296, 362/341, 307, 310, 311, 29, 235, 249, 355, 362/343, 361
See application file for complete search history.

(56) References Cited

U.S. PATENT DOCUMENTS

| | | | | |
|---|---|---|---|---|
| 4,929,866 | A * | 5/1990 | Murata et al. | 313/500 |
| 5,222,795 | A * | 6/1993 | Hed | 362/558 |
| 6,299,328 | B1 * | 10/2001 | Wilson | 362/223 |
| 6,550,942 | B1 * | 4/2003 | Zou et al. | 362/347 |
| 6,568,840 | B1 | 5/2003 | Mabe et al. | |
| 6,830,354 | B2 * | 12/2004 | Ono | 362/614 |
| 6,857,771 | B2 * | 2/2005 | Guerrieri | 362/555 |
| 2001/0040809 | A1 | 11/2001 | Sools et al. | |
| 2004/0233655 | A1 * | 11/2004 | Zimmerman et al. | 362/19 |
| 2005/0180167 | A1 * | 8/2005 | Hoelen et al. | 362/613 |
| 2005/0237744 | A1 * | 10/2005 | Marra et al. | 362/279 |

FOREIGN PATENT DOCUMENTS

| | | | |
|---|---|---|---|
| EP | 0340954 | A2 | 11/1989 |
| EP | 0340954 | A3 | 11/1989 |
| EP | 0340954 | B1 | 11/1989 |
| GB | 0357257 | | 9/1931 |
| JP | 07084531 | A | 3/1995 |
| JP | 2000276908 | A | 10/2001 |

* cited by examiner

*Primary Examiner*—Thomas M. Sember

(57) ABSTRACT

A lighting device (1) comprising at least one light source (3) as well as a light reflector disposed beside the light source (3) for reflection of at least part of the light radiated from the light source (3), a special feature being the fact that the light reflector comprises at least one light-transmitting element (4) bounding a space (5) at least in part, as well as a diffusely reflective powder (6) present inside said space (5).

18 Claims, 3 Drawing Sheets

LIGHTING DEVICE

Figure 1:
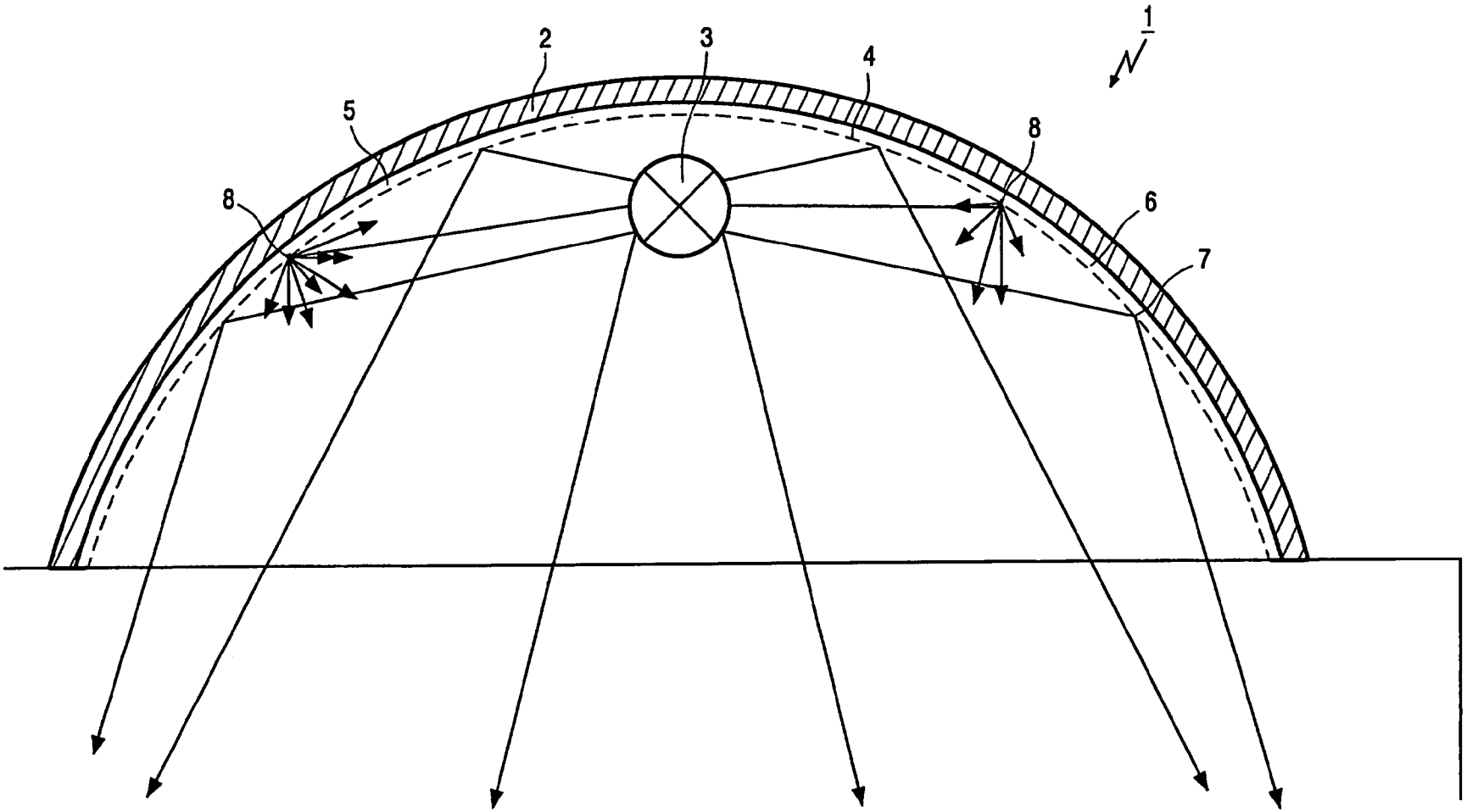

The invention relates to a lighting device comprising at least one light source as well as a light reflector disposed beside the light source for reflection of at least part of the light radiated from the light source. It is noted that the term "beside" is understood to mean any spatial orientation, such as below, above, alongside, etc.

Such a lighting device is generally known. In a known lighting device, one or more light sources, such as TL tubes, are arranged in a rectangular lighting housing provided with a reflecting rear wall and reflecting sidewalls. As a rule, a light-transmitting diffuser plate is present on the front side of the lighting housing for lateral homogenisation of the light beam being emitted from the lighting device. Furthermore, one or more optically modulating foils may be present at the side of the diffuser plate facing away from the light source, for example for restricting the angular range of the light being emitted and/or imparting a particular polarization to the light being emitted. Such a lighting device is for example used for the back-lighting of non-emissive displays, such as LC displays, for the visual inspection of X-ray photographs, for advertising billboards, for drawing tables, for flat luminaire tiles and/or for showcases for jewelry. The rear wall and the side walls of the aforesaid lighting device are preferably diffusely reflective, so that light that is not radiated from the light source directly towards the front side of the lighting device can subsequently be back-reflected via one or more diffuse reflections towards the front of the lighting device, thus enabling light recycling. Normally, the rear wall and the side walls of the lighting housing are made diffusely reflective by coating them with a white coating layer consisting of white particles in an organic binder matrix. The binder fixes the particles in the coating and bonds the coating layer to the interior walls of the lighting housing. Usually, the coating has an optically rough surface facing towards the light source so as to prevent the occurrence of specular reflections and to effect a proper homogenisation of the diffusely reflected light inside the lighting device. The precise positioning of the coating layer relative to the position of the light source is of minor importance in this connection.

In another known lighting device, the light source, for example in the form of a CDM lamp, is present inside a lighting fixture which functions as the housing of the light source and which partly surrounds the light source, whilst the lighting fixture itself comprises an essentially optically smooth surface facing towards the light source. The shaping, orientation, and spacing of the said optically smooth surface around the light source being carefully adjusted so as to obtain a controlled angular shaping of the emitted light beam from the lighting device. Said surface, which generally consists of aluminium, functions to specularly reflect the light away from the CDM lamp within a particular angular range, so as to realise a particular light intensity output of a specific angular intensity distribution at a certain distance from the CDM lamp. One drawback of the aluminium surface of the lighting fixture is that it absorbs a considerable amount of incident light thereon. Moreover, it is often difficult to realise a sufficiently smooth aluminium surface, and the optical smoothness of the aluminium surface, i.e. the ability to specularly reflect light, strongly decreases with the passage of time, in particular owing to corrosion. As a result, the light output of the known lighting device deteriorates in the course of time. It is known, however, to overcome these drawbacks by providing the surface of the lighting fixture that faces towards the light source with a white, smooth coating consisting of white, light-scattering particles, which are present in a binder matrix layer and which are bonded to the surface of the lighting fixture therewith. Part of the light from the CDM lamp is specularly reflected by the coating, whilst another part is diffusely reflected. Insofar as the coating provides specular reflection, it functions to restrict the angular intensity distribution range of the light beam being emitted by the lighting device. The spatial positioning of the smooth coating surrounding the light source is important in this connection; preferably it should faithfully follow the shape of the surface of the lighting fixture that faces towards the light source.

One drawback of the aforesaid coating is that the application thereof is objectionable for environmental reasons, since organic solvents are generally used, whilst on the other hand its application is time-consuming, because relatively thick coating layers are required which need to be dried carefully. Furthermore, the coating is usually not capable of withstanding the high operating temperatures of the lighting device, which may be in the order of a few hundred degrees Celsius, as a result of which discolouration and light absorption can take place, which, with the passage of time, may lead to an undesirable shifting of the colour point and a reduced light output.

The object of the invention is to overcome the drawbacks of the prior art, and in order to accomplish that objective, a lighting device of the kind referred to in the introduction is characterized in that the light reflector comprises at least one light-transmitting element bounding a space at least in part and forming an inner side of the housing, as well as a diffuse reflective powder present inside said space. The powder, which is in particular of the "free-flowing" type, preferably comprises calcium halophosphate, calcium pyrophosphate, $BaSO_4$, MgO, $YBO_3$, $TiO_2$ or $Al_2O_3$ particles. Such a powder is resistant against high temperatures, whilst important chemical properties thereof do not deteriorate as a result of being exposed to high temperatures, light and/or moisture. The light-transmitting element, if provided with optically smooth surfaces, on the one hand provides specular reflection of part of the incident light thereon, and on the other hand it directs another part of the incident light thereon towards the powder. The powder, in turn, provides diffuse reflection (i.e. back-scattering) of said light back through the light transmitting element into the direction of the light source. The light-transmitting element, if provided with optically roughened surfaces, counteracts the occurrence of specular reflections. The presence of the optically roughened, light-transmitting element and of the powder in that case ensure that a substantially complete diffuse reflection is obtained.

In one preferred embodiment of a lighting device according to the invention, the particles have an average diameter ranging between 0.1 and 100 μm, in particular 5 to 20 μm. In order to obtain a "free-flowing" type powder, said particles are ideally mixed with fine-grained $Al_2O_3$ particles having an average diameter which ranges between 10 and 50 nm. The amount of the latter particles, also known as Alon-C (Degussa, Frankfurt), preferably ranges between 0.1 and 5 wt. %, in particular 0.5 to 3 wt. %.

In another preferred embodiment of a lighting device according to the invention, the space has a thickness greater than or equal to 0.5 mm, in particular greater than or equal to 1 mm, more in particular greater than or equal to 2 mm. Experiments have shown that these are the most suitable values, in the sense that, when a typical powder volume packing density of 30-60% in the space is present, a sufficient amount of powder is present to substantially completely reflect incident light thereon.

In another preferred embodiment of a lighting device according to the invention, the light-transmitting element is a plate of glass or a synthetic material, which may or may not be flat. The space is in particular bounded, at least in part, by the light-transmitting element and by another light-transmitting element, so that a sandwich structure of two light-transmitting elements is obtained, the powder being present in the space between the two light-transmitting elements. In another preferred variant, the space is bounded, at least in part, by the light-transmitting element and by a component of the lighting device, in particular a housing of the light source or a lighting fixture of the lighting device.

In another preferred embodiment of a lighting device according to the invention, the powder is mixed with colour pigments. This provides the decorative effect whereby it appears as if (partially) coloured light is being emitted by the lamp.

In another preferred embodiment of a lighting device according to the invention, the powder is incapable of absorbing light, at least light having a wavelength in the visible wavelength range. Any loss of light in this wavelength range due to absorption is thus prevented.

In another preferred embodiment of a lighting device according to the invention, a surface of the light-transmitting element facing towards the light source is optically roughened. A surface of the light-transmitting element facing towards the powder may likewise be optically roughened. This enhances the diffuse nature of the light being reflected by the diffuse light reflector.

The invention also relates to a method for manufacturing a lighting device, in which at least one light source and at least one lighting fixture are supplied and in which a light reflector is arranged beside the light source for diffuse reflection of at least part of light radiated from the light source and for specular reflection of at least another part of the light radiated from the light source so as to increase light output of the lighting device and to restrict the angular distribution of the intensity of the emitted light beam from the lighting device, characterized in that at least one light-transmitting element bounding a space at least in part, as well as a diffusely reflective powder present inside said space are used as the light reflector, wherein the light-transmitting element comprises at least two substantially parallel, substantially optically smooth surfaces, and wherein the surface of the light-transmitting element that faces towards the light source extends substantially parallel to the surface of the lighting fixture facing the lamp.

Figure 2:
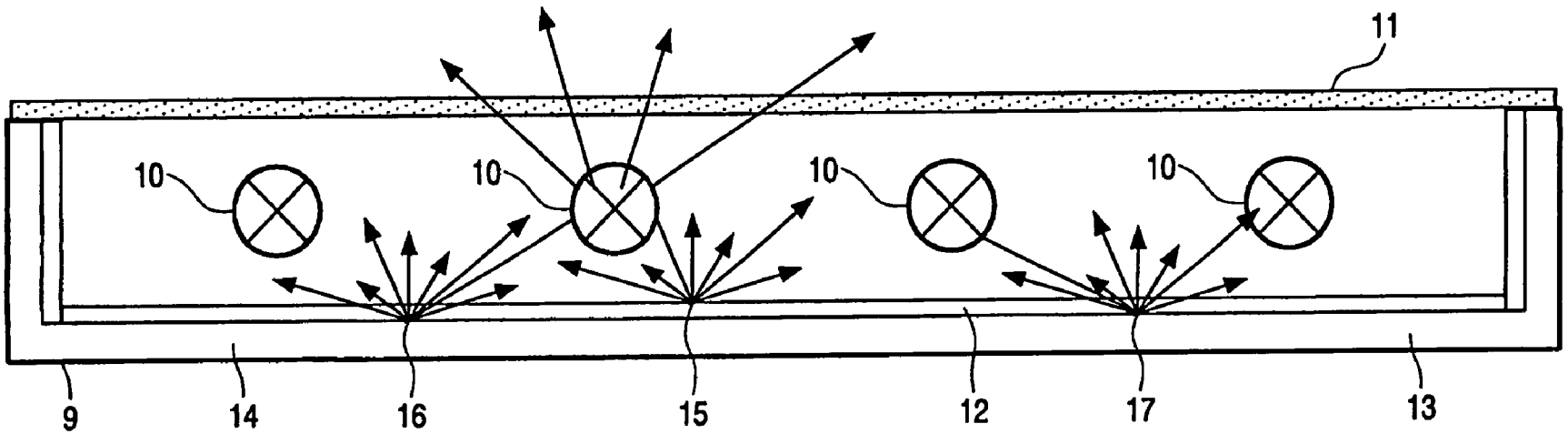
Figure 3:
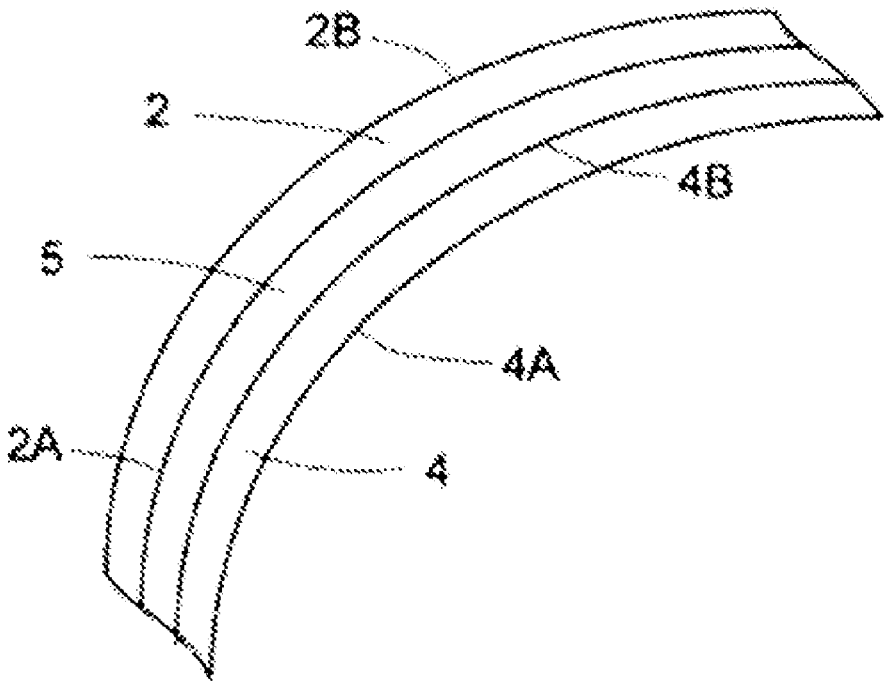

The invention will now be explained in more detail with reference to FIGS. 1-3 illustrated in a drawing, FIGS. 1 and 2 being a schematic side elevation of two embodiments of a lighting device according to the invention, and FIG. 3 being a more detailed view of a portion of embodiment of FIG. 1.

FIG. 1 shows a lighting device 1 comprising a lamp 3 fitted in a lighting fixture 2. A diffuse light reflector comprising a light-transmitting glass plate 4 is arranged on the inner surface of the lighting fixture 2 in a continuous manner. The plate 4 is spatially curved such as to correspond to the spatial curvature of the inner surface of the lighting fixture 2, and it is arranged in a spaced-apart relationship thereto so that an intermediate space 5 having a thickness of 1 mm is formed between the glass plate 4 and the lighting fixture 2. The intermediate space 5 is filled with a powder 6 comprising calcium pyrophosphate. The calcium pyrophosphate particles are mixed with $Al_2O_3$ particles so as to give the powder 6 its "free-flowing" character. Colour pigments may be added to the powder 6. The figure shows the path of the rays of light emitted by the lamp 3, part of which is subsequently specularly reflected by the glass plate 4 (see, for example, at location 7), whilst another part is diffusely reflected by the powder 6 (see, for example, at location 8). Said diffuse reflection may be enhanced by optically roughening the surface of the glass plate 4 that faces towards the lamp 3.

FIG. 2 refers to a light box comprising a housing 9 with four TL-tubes 10 mounted therein, as well as a diffuser plate 11 placed on top of the housing 9. The light reflector according to the invention comprises a light transmitting element 12 following the contours of the inner surface of the housing 9, such that an intermediate space 13 is formed filled with the powder 14 in the way as mentioned in respect of FIG. 1. The light transmitting element 12 has an optically roughened surface facing towards TL-tubes 10, so that it prevents the occurrence of specular reflections and it provides diffuse reflections, for example at location 15. The powder 14 in turn provides diffuse reflection, for example at locations 16 and 17.

FIG. 3 shows a more detailed view of a portion of the embodiment of FIG. 1, in which fixture 2 and light transmitting element 4 both have substantially parallel surfaces 2A, 2B, 4A and 4B. Surfaces 2A and 4A face toward the lamp 3, while surface 4B faces the fixture 2. Surfaces 4A and 4B of light transmitting element may both be substantially optically smooth surfaces, or one or both of these surfaces may optionally be optically roughened.

The invention is not limited to the embodiment as discussed above, it also extends to other variants that fall within the scope of the appended claims. Thus, it will be apparent to a person skilled in the art that the glass plate 4 in FIG. 1 does not necessarily need to continuously follow the contours of the inner surface of the lighting fixture 2, but alternatively it may be arranged discretely (discontinuously) along said inner surface.

The invention claimed is:

1. A lighting device comprising at least one light source as well as a light reflector disposed beside the light source for reflection of at least part of the light radiated from the light source, characterized in that the light reflector comprises at least one light-transmitting element bounding a space at least in part, as well as a diffusely reflective 'free flowing' powder present inside said space.

2. A lighting device according to claim 1, wherein said powder comprises calcium halophosphate, calcium pyrophosphate, $BaSO_4$, MgO, $YbO_3$, $TiO_2$ or $Al_2O_3$ particles.

3. A lighting device according to claim 2, wherein the particles have an average diameter ranging between 0.1 and 100 μm.

4. A lighting device according to claim 3, wherein the particles have an average diameter ranging between 5 and 20 μm.

5. A lighting device according to claim 2, wherein said particles are mixed with fine-grained $Al_2O_3$ particles having an average diameter which ranges between 10 and 50 nm.

6. A lighting device according to claim 5, wherein the amount of fine-grained $Al_2O_3$ particles having an average diameter ranging between 10 and 50 nm ranges between 0.1 and 5 wt. %.

7. A lighting device according to claim 6, wherein the amount of fine-grained $Al_2O_3$ particles having an average diameter ranging between 10 and 50 nm ranges between 0.5 and 3 wt.%.

8. A lighting device according to claim 1, wherein said space has a thickness greater than or equal to 0.5 mm.

9. A lighting device according to claim 8, wherein said space has a thickness greater than or equal to 1 mm.

10. A lighting device according to claim 9, wherein said space has a thickness greater than or equal to 2 mm.

11. A lighting device according to claim 1, wherein the light-transmitting element is a plate of glass or a synthetic material.

12. A lighting device according to claim 1, wherein said space is bounded, at least in part, by said light-transmitting element and by another light-transmitting element.

13. A lighting device according to claim 1, wherein said space is bounded, at least in part, by said light-transmitting element and by another light-transmitting element.

14. A lighting device according to claim 1, wherein said powder is mixed with colour pigments.

15. A lighting device according to claim 1, wherein the powder is incapable of absorbing light, at least light having a wavelength in the visible range.

16. A lighting device according to claim 1, wherein a surface of the light-transmitting element facing towards the light source is optically roughened.

17. A lighting device according to claim 16, wherein a surface of the light-transmitting element facing towards the powder is likewise optically roughened.

18. A method for manufacturing a lighting device, in which at least one light source and at least one lighting fixture having a surface facing the light source are supplied and in which a light reflector is arranged beside the light source for diffuse reflection of at least part of the light radiated from the light source and for specular reflection of at least another part of the light radiated from the light source so as to increase light output of the lighting device and to restrict the angular distribution of the intensity of the emitted light bean from the lighting device, characterized in that at least one light-transmitting element bounding a space at least in part, as well as a diffusely reflective 'free flowing' powder present inside said space are used as the light reflector, wherein the light-transmitting element comprises at least two substantially parallel, substantially optically smooth surfaces, a first surface facing towards the light source and a second surface facing towards the lighting fixture, and wherein the surface of the light-transmitting element that faces towards the light source extends substantially parallel to the surface of the lighting fixture facing the light source.

* * * * *